US006383374B1

(12) United States Patent
Splendorio

(10) Patent No.: US 6,383,374 B1
(45) Date of Patent: May 7, 2002

(54) POOL SKIMMER SYSTEM

(76) Inventor: Dominick Splendorio, 11428 Nest Ct., Port Richey, FL (US) 34668

( * ) Notice: Subject to any disclaimer, the term of this patent is extended or adjusted under 35 U.S.C. 154(b) by 0 days.

(21) Appl. No.: 09/881,878

(22) Filed: Jun. 15, 2001

(51) Int. Cl.[7] ..... E04H 4/16
(52) U.S. Cl. ..... 210/169; 210/238; 210/470
(58) Field of Search ..... 210/169, 232, 210/470, 238

(56) References Cited

U.S. PATENT DOCUMENTS 899,724 A * 9/1908 Golden
2,583,987 A * 1/1952 Baisor
5,043,060 A * 8/1991 Brehnan
5,167,805 A * 12/1992 Theiss
5,350,508 A * 9/1994 Van der Watt
5,422,001 A * 6/1995 Yagoda et al.

* cited by examiner

*Primary Examiner*—Thomas M. Lithgow

(57) ABSTRACT

A pool skimmer system for facilitating the removal of debris from pools. The pool skimmer system includes a skimmer assembly, which is substantially buoyant for facilitating skimming along a top surface of a pool and designed for collecting debris, and a handle assembly which includes a proximal end pivotally coupled to the skimmer assembly and a distal end designed for grasping by a human hand is used to facilitate placement of the skimmer assembly in an interior position of the top surface of the pool being skimmed.

6 Claims, 1 Drawing Sheet

POOL SKIMMER SYSTEM

BACKGROUND OF THE INVENTION

1. Field of the Invention

The present invention relates to pool skimmers and more particularly pertains to a new pool skimmer system for facilitating the removal of debris from pools.

2. Description of the Prior Art

The use of pool skimmers is known in the prior art. More specifically, pool skimmers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,822,487; U.S. Pat. No. 4,846,972; U.S. Pat. No. 5,342,513; U.S. Pat. No. Des. 330,444; U.S. Pat. No. 5,084,177; and U.S. Pat. No. 3,220,037.

While these devices fulfill their respective, particular objectives and requirements, the aforementioned patents do not disclose a new pool skimmer system. The inventive device includes a skimmer assembly, which is substantially buoyant for facilitating skimming along a top surface of a pool and designed for collecting debris, and a handle assembly which includes a proximal end pivotally coupled to the skimmer assembly and a distal end designed for grasping by a human hand is used to facilitate placement of the skimmer assembly in an interior position of the top surface of the pool being skimmed.

In these respects, the pool skimmer system according to the present invention substantially departs from the conventional concepts and designs of the prior art, and in so doing provides an apparatus primarily developed for the purpose of facilitating the removal of debris from pools.

SUMMARY OF THE INVENTION

In view of the foregoing disadvantages inherent in the known types of pool skimmers now present in the prior art, the present invention provides a new pool skimmer system construction wherein the same can be utilized for facilitating the removal of debris from pools.

The general purpose of the present invention, which will be described subsequently in greater detail, is to provide a new pool skimmer system apparatus and method which has many of the advantages of the pool skimmers mentioned heretofore and many novel features that result in a new pool skimmer system which is not anticipated, rendered obvious, suggested, or even implied by any of the prior art pool skimmers, either alone or in any combination thereof.

To attain this, the present invention generally comprises a skimmer assembly, which is substantially buoyant for facilitating skimming along a top surface of a pool and designed for collecting debris, and a handle assembly which includes a proximal end pivotally coupled to the skimmer assembly and a distal end designed for grasping by a human hand is used to facilitate placement of the skimmer assembly in an interior position of the top surface of the pool being skimmed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool skimmer system apparatus and method which has many of the advantages of the pool skimmers mentioned heretofore and many novel features that result in a new pool skimmer system which is not anticipated, rendered obvious, suggested, or even implied by any of the prior art pool skimmers, either alone or in any combination thereof.

It is another object of the present invention to provide a new pool skimmer system which may be easily and efficiently manufactured and marketed.

It is a further object of the present invention to provide a new pool skimmer system which is of a durable and reliable construction.

An even further object of the present invention is to provide a new pool skimmer system which is susceptible of a low cost of manufacture with regard to both materials and labor, and which accordingly is then susceptible of low prices of sale to the consuming public, thereby making such pool skimmer system economically available to the buying public.

Still yet another object of the present invention is to provide a new pool skimmer system which provides in the apparatuses and methods of the prior art some of the advantages thereof, while simultaneously overcoming some of the disadvantages normally associated therewith.

Still another object of the present invention is to provide a new pool skimmer system for facilitating the removal of debris from pools.

Yet another object of the present invention is to provide a new pool skimmer system which includes a skimmer assembly, which is substantially buoyant for facilitating skimming along a top surface of a pool and designed for collecting debris, and a handle assembly which includes a proximal end pivotally coupled to the skimmer assembly and a distal end designed for grasping by a human hand is used to facilitate placement of the skimmer assembly in an interior position of the top surface of the pool being skimmed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
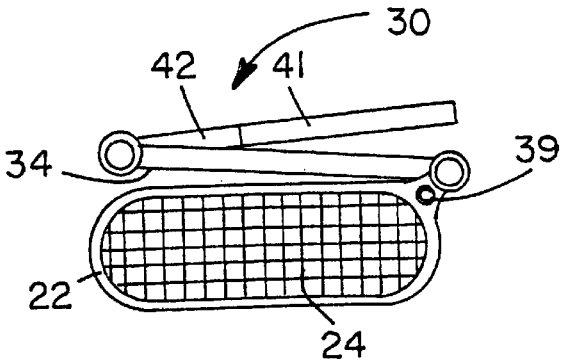
FIG. 2 is a schematic top view of the present invention.
Figure 1:
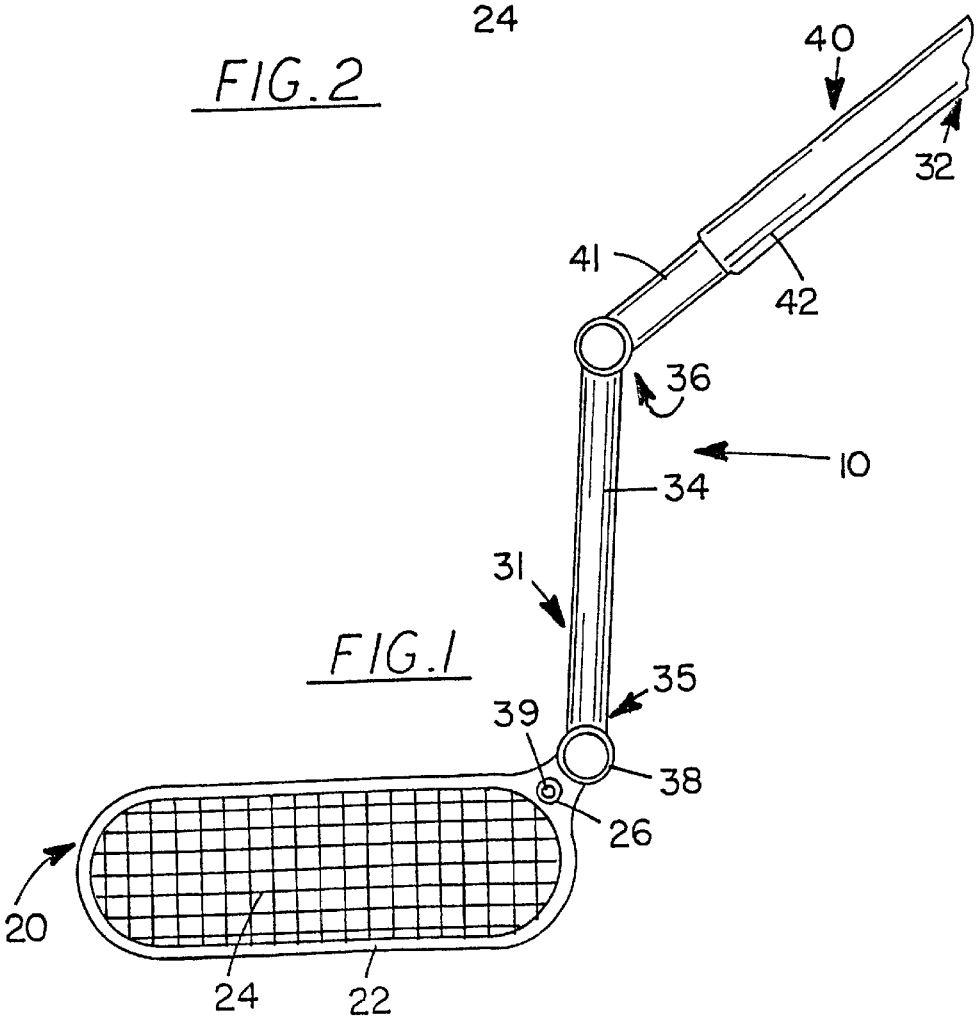
FIG. 1 is a schematic perspective view of a new pool skimmer system according to the present invention.

With reference now to the drawings, and in particular to FIGS. 1 through 2 thereof, a new pool skimmer system embodying the principles and concepts of the present invention and generally designated by the reference numeral 10 will be described.

As best illustrated in FIGS. 1 through 2, the pool skimmer system 10 generally comprises a skimmer assembly 20 and a handle assembly 30.

The skimmer assembly 20 is designed for collecting debris from a top surface of a pool. The skimmer assembly 20 is substantially buoyant for facilitating skimming along the top surface.

The handle assembly 30 includes a proximal end 31, which is pivotally coupled to the skimmer assembly 20. The handle assembly 30 also includes a distal end 32, which is designed for grasping by a human hand. The handle assembly 30 facilitates placement of the skimmer assembly 20 in an interior position of the top surface of the pool being skimmed.

The handle assembly 30 further comprises a first extent 34 and a telescopic assembly 40. The first extent 34 includes a first 35 and second end 36. The first end 35 is removably and pivotally coupled to the skimmer assembly 20 for facilitating placement of the skimmer assembly 20. The telescopic assembly 40 includes a plurality of nesting extents such that a first nesting extent 41 is slideably positionable within an interior portion of a second nesting extent 42. The first nesting extent 41 is pivotally coupled to the second end 36 of the first extent 34 for facilitating placement of the skimmer assembly 20.

The skimmer assembly 20 further comprises a frame member 22 and a netting member 24. The frame member 22 defines a perimeter of the skimmer assembly 20. The frame member 22 is substantially hollow for providing buoyancy. The frame member 22 is substantially elliptical for facilitating movement along the top surface of the pool. The netting member 24 is designed for catching debris floating on the top surface of the pool.

The skimmer assembly 20 also an aperture 26, which extends through a perimeter wall. The proximal end 31 of the handle assembly 30 includes a pivot assembly 38 with a pin member 39. The pin member 39 is positionable through the aperture 26 for securing the skimmer assembly 20 to the handle assembly 30. The pivot assembly 38 facilitates positioning of the skimmer assembly 20.

In an embodiment the frame member 22 is comprised of PVC piping.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool skimmer system comprising:

a skimmer assembly adapted for collecting debris from a top surface of a pool, said skimmer assembly being substantially buoyant for facilitating skimming along the top surface;

a handle assembly having a proximal end pivotally coupled to said skimmer assembly, said handle assembly having a distal end adapted for grasping by a human hand, said handle assembly facilitating placement of said skimmer assembly in an interior position of the top surface of the pool being skimmed and, said handle assembly further comprises a first extent having a first and second end, said first end being removably coupled to said skimmer assembly, said first end being pivotally coupled to said skimmer assembly for facilitating placement of said skimmer assembly;

a telescopic assembly having a plurality of nested extents such that a first nesting extent is slideably positionable within an interior portion of a second nesting extent, said first nesting extent being pivotally coupled to said second end of said first extent for facilitating placement of said skimmer assembly.

2. The pool skimmer system of claim 1, wherein said skimmer assembly further comprises:

a frame member defining a perimeter of said skimmer assembly, said frame member being substantially hollow for providing buoyancy, said frame member being substantially elliptical for facilitating movement along the top surface of the pool.

3. The pool skimmer system of claim 2, wherein said frame member comprises pvc piping.

4. The pool skimmer system of claim 1, wherein said skimmer assembly further comprises:

a netting member adapted for catching debris floating on the top surface of the pool.

5. The pool skimmer system of claim 1, further comprises:

said skimmer assembly having an aperture extending through a perimeter wall;

said proximal end of said handle assembly having a pivot assembly including a pin member, said pin member being positionable through said aperture for securing said skimmer assembly to said handle assembly, said pivot assembly facilitating positioning of said skimmer assembly.

6. A pool skimmer system comprising:

a skimmer assembly adapted for collecting debris from a top surface of a pool, said skimmer assembly being substantially buoyant for facilitating skimming along the top surface;

a handle assembly having a proximal end pivotally coupled to said skimmer assembly, said handle assembly having a distal end adapted for grasping by a human hand, said handle assembly facilitating placement of said skimmer assembly in an interior position of the top surface of the pool being skimmed;

said handle assembly further comprises:

a first extent having a first and second end, said first end being removably coupled to said skimmer assembly, said first end being pivotally coupled to said skimmer assembly for facilitating placement of said skimmer assembly;

a telescopic assembly having a plurality of nesting extents such that a first nesting extent is slideably positionable within an interior portion of a second nesting extent, said first nesting extent being pivotally coupled to said second end of said first extent for facilitating placement of said skimmer assembly;

said skimmer assembly further comprises:

a frame member defining a perimeter of said skimmer assembly, said frame member being substantially hollow for providing buoyancy, said frame member being substantially elliptical for facilitating movement along the top surface of the pool;

a netting member adapted for catching debris floating on the top surface of the pool;

said skimmer assembly having an aperture extending through a perimeter wall;

said proximal end of said handle assembly having a pivot assembly including a pin member, said pin member being positionable through said aperture for securing said skimmer assembly to said handle assembly, said pivot assembly facilitating positioning of said skimmer assembly; and wherein said frame member comprises pvc piping.

* * * * *